US005466497A

United States Patent [19]

Mosler

[11] Patent Number: 5,466,497

[45] Date of Patent: Nov. 14, 1995

[54] FUR FABRIC AND METHOD OF PRODUCTION

[75] Inventor: Michel Mosler, Toronto, Canada

[73] Assignee: R. B. Management Inc., Toronto, Canada

[21] Appl. No.: 135,342

[22] Filed: Oct. 13, 1993

[30] Foreign Application Priority Data

May 19, 1993 [CA] Canada ..... 2096577
Jun. 14, 1993 [CA] Canada ..... 2098352

[51] Int. Cl.[6] ..... C14B 15/08; A41H 41/00

[52] U.S. Cl. ..... 428/15; 69/22; 69/23; 112/16; 428/16; 428/92; 428/95; 428/97; 428/102

[58] Field of Search ..... 428/102, 15, 16, 428/92, 95, 97, 102; 57/236, 260; 112/402, 412, 16, 18, 19, 20; 69/23, 22; 156/68

[56] References Cited

U.S. PATENT DOCUMENTS

| | | | |
|---|---|---|---|
| 255,201 | 3/1882 | Schoenchen | 428/102 |
| 307,509 | 11/1884 | Vorck | 428/102 |
| 2,416,758 | 3/1947 | Knowles | 66/202 |
| 2,805,564 | 9/1957 | Moore | 66/194 |
| 3,081,614 | 3/1963 | Salick | 69/22 |
| 3,293,796 | 12/1996 | Strader | 428/16 |
| 4,637,206 | 1/1987 | Suwa | 69/22 |
| 5,167,113 | 12/1992 | Yoshioka | 57/236 |

FOREIGN PATENT DOCUMENTS

| | | |
|---|---|---|
| 1107487 | 8/1981 | Canada . |

*Primary Examiner*—Nasser Ahmad
*Attorney, Agent, or Firm*—Cushman, Darby & Cushman

[57] ABSTRACT

A fabric having a furry surface comprising an elongated strip of a hair-coated skin of a fur-bearing animal, said strip having a hair-free body portion and a hair-bearing portion extending the length of the strip at a lower part thereof such that the hair extends from said lower part substantially in or adjacent to a single plane; and a non-furry thread of reinforcing material sewn into and extending the length of said hair-free body portion. The invention provides a fabric having improved strength. Also provided are methods of manufacturing the fabric and sewn strips of improved strength.

13 Claims, 3 Drawing Sheets

FUR FABRIC AND METHOD OF PRODUCTION

FIELD OF THE INVENTION

This invention relates to a fabric comprised of strips of fur and to methods of making said fabric and said strips of fur. More particularly, the invention relates to a fabric having a furry surface and composed, either in whole or in part, of sewn or stitched strips of fur.

BACKGROUND TO THE INVENTION

Various methods of knitting fur are known to the art. In U.S. Pat. No. 2,416,758—Knowles, a yarn-like strand is formed by inserting a bunch of hairs from a fur-bearing animal into each of a series of side-by-side loops in a thread of cotton, rayon or the like. The thread is pulled tight to pull the hairs in place in the loops and the resulting strand is fashioned into a fabric by knitting or crocheting. The hairs do not radiate outwardly from all sides of the thread but are disposed substantially in or adjacent a single plane on opposing sides of the thread.

Because Knowles requires the insertion of the hair into the loops of the thread which is an extremely time consuming operation, such an article is more expensive to manufacture than need otherwise be.

In U.S. Pat. No. 2,805,564—Moore, fibres at the edges of skins of fur-bearing animals are joined by knitting to form a fabric having parallel blended stripes.

Moore suffers from the drawback that it cannot be fashioned into seamless garments of a variety of shapes and provides a finished fabric which is relatively wide and must be cut and sewn into a garment in the same way as skins of animals.

Canadian Patent No. 1107487—Lishman, describes a fabric formed by weaving, knitting or crocheting strips of fur-bearing skin having oppositely facing furry surfaces formed by twisting the strips to form an elongated longitudinally extended core having hairs standing rigidly outward of the skin and which fully encircles the core. The core may, optionally, fully embrace a non-furry length of cord or thread material to provide reinforcement to the strip of skin, particularly, during the twisting step and also when the fabric is worn.

However, the present invention provides improved strength products either requiring or not requiring the twisting of a strip of skin prior to manufacture into a fabric formed therefrom.

SUMMARY OF THE INVENTION

The invention provides fabrics of improved strength having fur either substantially on one surface, only, generally the outer side of a coat, jacket and the like made therefrom, or on each of the oppositely facing surfaces to provide coats and the like having inner and outer furry surfaces. The enhanced strength of the fabric is provided by one or more reinforcing threads of non-furry material suitably and effectively sewn to the elongated strip of a hair-coated skin. The sewn strips may be, optionally, twisted by methods known in the art, including, optionally around a cord or thread to provide a composite yarn to provide further enhanced strength and hair distribution.

It is an object of the present invention to provide fabrics having a furry surface and of improved strength.

It is a further object to provide fabrics having oppositely facing furry surfaces and of improved strength.

It is yet a further object of the present invention to provide methods of manufacture of a fabric of improved strength as hereinabove provided.

These and other objects of the invention will be readily apparent from a reading of the specification as a whole.

Accordingly, the invention provides in one aspect a fabric having a furry surface comprising an elongated strip of a hair-coated skin of a fur-bearing animal, said strip having a hair-free body portion and a hair-bearing portion extending the length of the strip at a lower part thereof such that the hair extends from said lower part substantially in or adjacent to a single plane; and a non-furry thread of reinforcing material sewn into and extending the length of said hair-free body portion.

The term "sewn" includes stitched and like millinery processes and the term "thread" includes filament, cord and like millinery forms. The non-furry reinforcing material may be selected by the man skilled in the art as being appropriate for its function of providing a reinforcing effect. Such materials, include cotton, rayon and synthetic plastics such as polyethylene, nylon and polypropylene.

The reinforcing thread is sewn into the hair-free body portion of the strip longitudinally of the length of the strip in either a spirally formed manner adjacent the edge of the strip remote from the fur-bearing portion and/or linearly of the length of the strip parallel thereto.

For additional reinforcement, the fabric is formed of strips of material according to the invention further comprising an elongated reinforcing non-furry member, i.e. a thread, filament or cord and the like formed of reinforcing material as hereinabove described sewn to the hair-free body portion, the length of the strip.

The strip as hereinabove defined may comprise a plurality of strips, according to the invention, sewn at their ends, one to the other to provide an extended strip for subsequent forming into the fabric. Such strips may comprise fur-bearing portions of different animals and/or synthetic skins. Manufacture of extended lengths of strips, as herein described enables maximum utilization of an animal skin by the cutting of the skin into a plurality of individual strips, and an alternative method to cutting a full skin spirally to provide an extended length.

I have found that improved fabrics according to the invention may be further provided by the twisting of the sewn strip prior to forming of the fabric, which twisting is described in aforesaid Canadian Patent No. 1107487 and which methods of twisting are enclosed herein by reference.

Thus, in yet a further aspect, the invention provides a fabric having oppositely facing furry surfaces comprising an elongated strip having a hair-free body portion and a hair-bearing portion extending the length of said strip at a lower part thereof and a non-furry thread of reinforcing material sewn into and extending the length of said hair-free body portion; and wherein said sewn strip is twisted such that said skin forms an elongated longitudinally extending core of the strip and said hair stands radially outward from said skin and forms a substantially continuous outer layer which encircles said core.

In a further aspect the invention provides a method of manufacture of a fabric having a furry surface comprising an elongated strip of hairy-coated skin of a fur-bearing animal, said strip having a hair-free body portion and a hair-bearing portion extending the length of the strip at the lower part thereof such that the hair extends from said lower part substantially in or adjacent to a single plane, and a non-furry thread of reinforcing material sewn into and extending the length of said hair-free body portion comprising the steps of:

(a) cutting the hairy-coated skin to form an elongated strip of said hair-coated skin;

(b) providing a non-furry thread of reinforcing material;

(c) sewing said non-furry thread of reinforcing material into and extending the length of said hair-free body portion; and (d) forming said sewn strip into said fabric.

The sewing step of the process may be either effected by hand, by a conventional fur-sewing machine or serging machine.

The sewing step may be effected to produce the spirally longitudinally extending sewing pattern or the linearly longitudinally extending sewing pattern as hereinabove described.

In a further aspect the invention provides a method of manufacture as hereinabove defined further comprising sewing an elongated reinforcing non-furry member to the hair-free body portion extending the length of the strip.

I have found that fabrics as hereinabove defined may either have uneven distribution of hair on one side, e.g. on the outer side of a coat or jacket, relative to its other side, e.g. the coat inner side; or a substantially even distribution of hair to provide oppositely facing furry surfaces. Such evenness of hair distribution whereby the hair radially extends from the fabric may be provided by the brushing of the formed fabric or by subjecting the sewn skins of the formed fabric to a compressed air flow.

The invention further provides a method of production of a fabric having oppositely facing furry surfaces comprising an elongated strip of hairy-coated skin of a fur-bearing animal, said strip having a hair-free body portion and a hair-bearing portion extending the length of the strip at the lower part thereof and a non-furry thread of reinforcing material sewn into and extending the length of said hair-free body portion comprising the steps of:

(a) cutting the hairy-coated skin to form an elongated strip of said hair-coated skin;

(b) providing a non-furry thread of reinforcing material;

(c) sewing said non-furry thread of reinforcing material into and extending the length of said hair-free body portion to produce a sewn strip;

(d) twisting said sewn strip such that the skin forms an elongated longitudinally extending core of said sewn strip and the hair strands out radially from the skin and forms a substantially continuous outer layer which encircles the core; and (e) forming said twisted sewn strip into said fabric.

Thus, the invention provides in several of its aspects an elongated strip of a hair-coated skin of a fur-bearing animal suitably sewn with a non-furry thread of reinforcing materials which in one aspect further comprises an elongated reinforcing non-furry member sewn to the skin. Each of above sewn strips may be optionally twisted to provide enhanced strength, optionally formed with yet a further elongated non-furry piece.

The invention further provides fabrics as hereinabove defined having enhanced strength and, optionally, comprising strips of skin of different animals and/or synthetic materials.

The fabric according to the invention may yet further comprise non-furry yarn knitted, woven or crocheted with the sewn and/or twisted strips as herein above defined.

BRIEF DESCRIPTION OF THE DRAWINGS

In order that the invention may be better understood, preferred embodiments will now be described by way of example only, with reference to the drawings wherein.

Like references refer to like parts throughout the description of the drawings.

DESCRIPTION OF THE PREFERRED EMBODIMENTS

Figure 1:
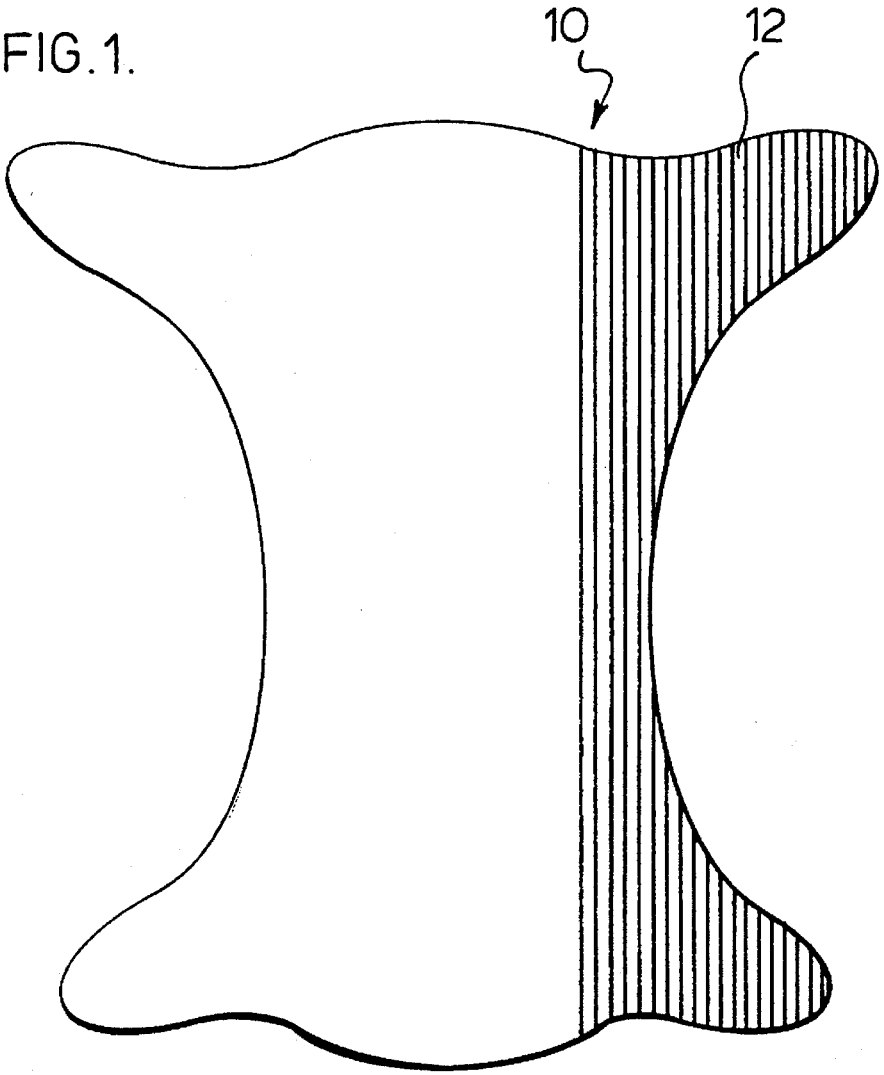
FIG. 1 represents a plan view of a longitudinally cut hairy-coated skin of a fur-bearing animal.

FIG. 1 sows a hairy-coated skin 10 of a fur-bearing animal sliced into a plurality of strips 12. In an alternative embodiment, the skin may be cut into relatively larger slices of, typically, 25 cm width, in those areas allowing of such width; and additionally, a plurality of strips of subsequently desired width. Strips 12 and, strips of wider width may be, subsequently, sewn one to the other at their ends thereof to provide an extended strip of desired width.

The hairy-coated skin 10 of a fur-bearing animal is preferably prepared for the illustrated cutting operation by means well-known in the art to increase its surface area by wetting and stretching thereof. After stretching, skin 10 may be dyed as may be desired. After stretching and dying, skin 10 is trimmed to remove its uneven outer edge. Skin 10 may be cut to the forms as hereinabove described either by hand or by machine.

Figure 2:
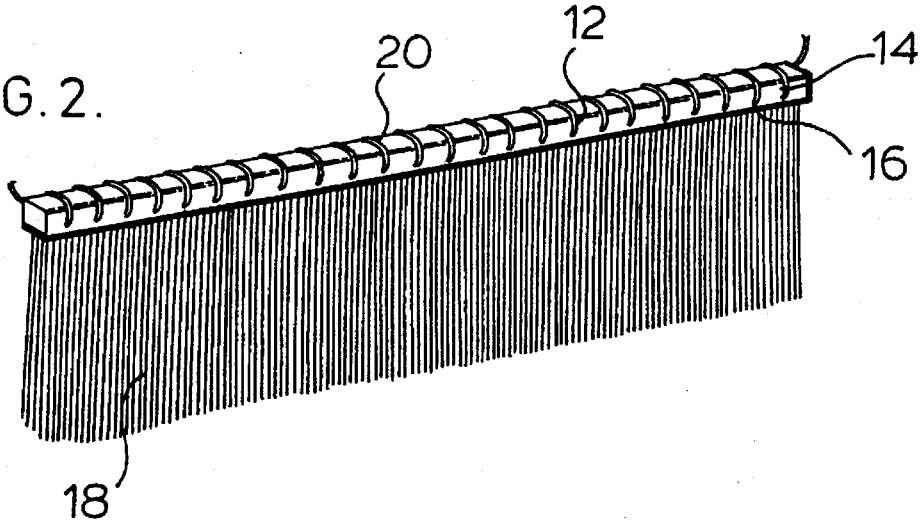
FIG. 2 is a perspective view of a portion of a strip cut as illustrated in FIG. 1 and sewn to provide a strip according to the invention.

With reference to FIG. 2, strip 12 has a hair-free body portion 14 and a hair-bearing portion 16 extending the length of strip 12 at a lower part thereof, having hair 18 extending substantially in or adjacent to a single plane. Spirally sewn, longitudinally of the length of hair-free body portion 14 is a nylon thread 20 constituting a reinforcing material. In an alternative embodiment shown in FIG. 3, a nylon thread 22 extends linearly and longitudinally the length of hair-free body portion 16.

Figure 4:
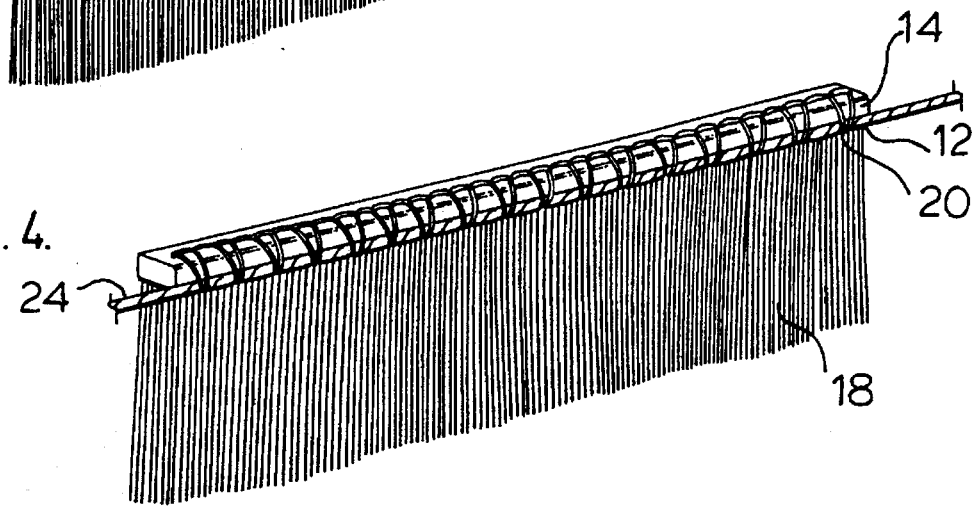
FIG. 4 represents a perspective view of a portion of a strip cut as illustrated in FIG. 2 further comprising an additional reinforcing member according to the invention.

With reference to FIG. 4, sewn elongated strip 12, as illustrated in FIG. 2, further has an additional elongated reinforcing non-furry member 24 sewn to hair-free body portion 14 and extending the length of strip 12.

For most applications, strip 12 of use in the manufacture of the fabric is about 2 mm–4 mm in width. Strips of such desired width may be either cut and shown as hereinabove described or cut to a width of twice the desired width, for example, 8 mm, sewn at one side of the hair-free body portion adjacent an edge and also sewn, similarly, adjacent the opposing longitudinal edge and subsequently cut lengthwise and central of the strip to provide two resultant strips according to the invention.

Figure 5:
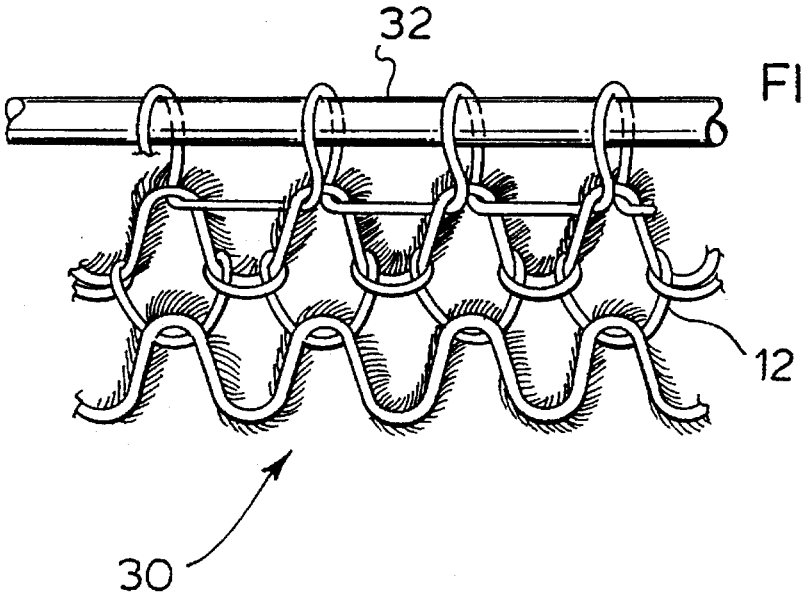
FIG. 5 is a fragmentary view of a knitted fabric according to the invention.

With reference to FIG. 5, elongated strip 12 comprising a plurality of strips 12 as shown in FIG. 4 with reinforcing member 24, sewn one end to another, is woven into a fabric shown generally as 30 using needles 32 in a conventional manner. The sewn strip may form both the warp and the weft of fabric 30 or it may form only one of the warp and weft while the other may be formed of a cord or thread of non-animal origin such as a cotton or synthetic fibre.

Figure 6:
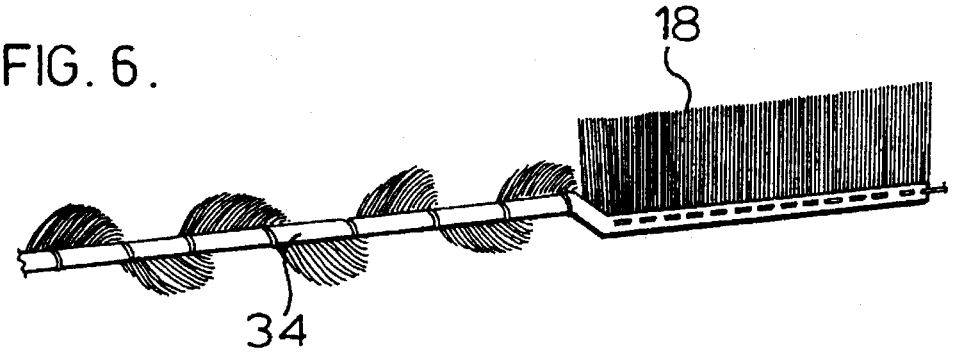
FIG. 6 is a perspective view of a twisted portion of a sewn strip as illustrated in FIG. 3 for use in a fabric according to the invention.
Figure 3:
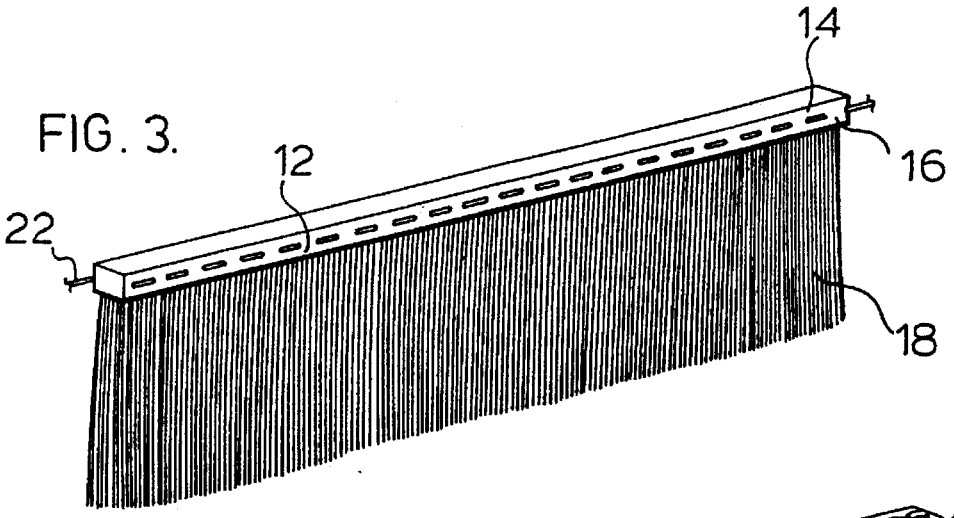
FIG. 3 is a perspective view of a portion of a strip as illustrated in FIG. 2 showing an alternative method of sewing according to the invention.

Strip 12 sewn as shown in FIG. 3 is twisted as illustrated in FIG. 6 so that the skin forms a core 34 of the strip and hair 18 stands out radially therefrom. The core of the sewn strip is longitudinally extending and hair 18 forms a substantially continuous outer layer which encircles the core. Twisting may be carried out by hard or mechanically by means of a spinning wheel, an electric motor or other rotating apparatus.

Figure 7:
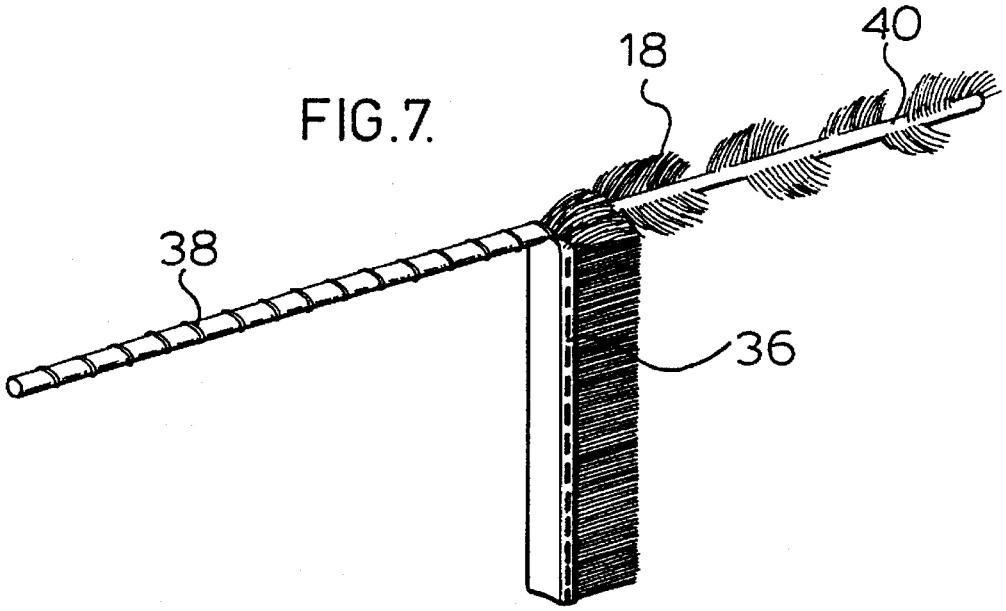
FIG. 7 is a perspective view of a portion of a sewn strip of hairy coated skin twisted around a cord or thread.

With reference to FIG. 7, a strip of hairy-coated skin 36 is twisted around an elongated cord or thread 38 and extends spirally around cord 38 and hair 18 stands out radially therefrom.

In area 40, cord 38, in the embodiment shown in FIG. 7, extends spirally around the outside of the strip and the sewn strip itself is twisted such as is illustrated in FIG. 6, so that the skin forms a core of the strip and the hair stands radially out therefrom. The skin and the cord are, thus, plyed together to form a variegated composite yarn in which the skin alternates with the cord along the length of the yarn.

The fabric of the invention may comprise wholly one or more strips of furry material or be composed of both furry and non-furry material.

Thus, the invention provides fabric as hereinbefore defined and described which has been strengthened to reinforce those areas susceptible to breakage either during manufacture or usage.

It is to be understood that modifications to the preferred embodiments of the invention described and illustrated herein can be made without departing from the scope and spirit of the invention as defined in the appended claims.

I claim:

1. A fabric having a furry surface made from an elongated strip of a hair-coated skin of a fur-bearing animal, said strip consisting essentially of a base skin layer and a hair coating such that said base layer provides a hair-free body portion extending the length of said strip and said hair coating provides a hair-bearing portion extending the length of the strip at a lower part thereof such that the hair extends from said lower part substantially in a single plane; and a non-furry thread of reinforcing material sewn into and extending the length of said hair-free body portion in such a manner so as to be free from contact with said hair bearing portion.

2. A fabric as claimed in claim 1 having oppositely facing furry surfaces comprising an elongated twisted strip having a hair-free body portion and a hair-bearing portion extending the length of said strip at a lower part thereof and a non-furry thread of reinforcing material sewn into and extending the length of said hair-free body portion; and wherein said sewn strip is twisted such that said skin forms an elongated longitudinally extending core of the strip and said hair stands radially outward from said skin and forms a substantially continuous outer layer which encircles said core.

3. A fabric as claimed in claim 1 wherein said thread of reinforcing material extends spirally and longitudinally the length of said hair-free body portion.

4. A fabric as claimed in claim 1 wherein said thread of reinforcing material extends linearly and longitudinally the length of said hair-free body portion.

5. A fabric as claimed in claim 1 further comprising an elongated reinforcing non-furry member sewn to said hair-free body portion and extending the length of said strip.

6. A fabric as claimed in claim 1 wherein said strip is knitted, woven or crocheted to form said fabric.

7. A fabric as claimed in claim 1 further comprising a non-furry yarn knitted, woven or crocheted with said strip.

8. A fabric as claimed in claim 1 wherein said non-furry thread of reinforcing material is formed of a material selected from the group consisting of cotton, rayon, nylon, polyethylene and polypropylene fibres.

9. An elongated strip of a hair-coated skin of a fur-bearing animal for use in forming a fabric, said strip consisting essentially of a base skin layer and a hair coating such that said base skin layer provides a hair-free body portion extending the length of the strip and the hair-coating provides a hair-bearing portion extending the length of the strip at a lower part thereof such that the hair extends from said lower part substantially in a single plane; and a non-furry thread of reinforcing material sewn into and extending the length of said hair-free body portion in such a manner so as to be free from contact with said hair bearing portion.

10. An elongated strip as claimed in claim 9 wherein said thread of reinforcing material extends spirally and longitudinally the length of said hair-free body portion.

11. An elongated strip as claimed in claim 9 wherein said thread of reinforcing material extends linearly and longitudinally the length of said hair-free body portion.

12. An elongated strip as claimed in claim 9 further comprising an elongated reinforcing non-furry member sewn to said hair-free body portion and extending the length of said strip.

13. A fabric as claimed in claim 2 further comprising a non-furry yarn knitted, woven or crocheted with said twisted strip.

* * * * *